US007083443B2

(12) United States Patent
Roset Rubio

(10) Patent No.: US 7,083,443 B2
(45) Date of Patent: Aug. 1, 2006

(54) CONNECTOR ASSEMBLY SCREW AND ANCHOR SECURITY DEVICE

(75) Inventor: Josep Maria Roset Rubio, Valls (ES)

(73) Assignee: Lear Corporation, Smithfield, MI (US)

( * ) Notice: Subject to any disclaimer, the term of this patent is extended or adjusted under 35 U.S.C. 154(b) by 112 days.

(21) Appl. No.: 10/709,679

(22) Filed: May 21, 2004

(65) Prior Publication Data

US 2004/0198092 A1 Oct. 7, 2004

(51) Int. Cl.
*H01R 13/62* (2006.01)
*H01R 13/44* (2006.01)
*H01R 13/60* (2006.01)

(52) U.S. Cl. ..... 439/157; 439/133; 439/131

(58) Field of Classification Search ..... 439/133, 439/131, 157, 752; 411/344, 30
See application file for complete search history.

(56) References Cited

U.S. PATENT DOCUMENTS

| | | | | |
|---|---|---|---|---|
| 4,460,298 | A * | 7/1984 | Solarz et al. | 411/15 |
| 5,221,814 | A * | 6/1993 | Colbaugh et al. | 174/66 |
| 5,244,324 | A * | 9/1993 | Smith | 411/344 |
| 5,690,454 | A * | 11/1997 | Smith | 411/30 |
| 5,791,845 | A * | 8/1998 | Fulop | 411/42 |
| 5,944,466 | A * | 8/1999 | Rudnicki et al. | 411/344 |
| 5,975,939 | A * | 11/1999 | Market | 439/415 |
| 6,004,158 | A | 12/1999 | Ward | 439/595 |
| 6,398,579 | B1 * | 6/2002 | Banas et al. | 439/372 |
| 6,406,233 | B1 * | 6/2002 | Shaner | 411/21 |

* cited by examiner

*Primary Examiner*—Chandrika Prasad
(74) *Attorney, Agent, or Firm*—Bruce E. Harang

(57) ABSTRACT

The connector assembly security device refers to a device used for verifying the proper position of a connector in an assembly, said connector provided with a number of connection terminals connected to conductor cables, and which is intended for being housed on a base part, also provided with connection terminals. Likewise, it is also a function of said device to carry out a second retention in case the first retention existing between the connector and the base part fails, thus preventing disconnection.

2 Claims, 4 Drawing Sheets

CONNECTOR ASSEMBLY SCREW AND ANCHOR SECURITY DEVICE

BACKGROUND OF INVENTION

1. Object of the Invention

The present invention, a connector assembly security device, refers to a device used for verifying the correct position of a connector in an assembly, said connector being provided with a number of connection terminals connected to conductor cables and which is intended to be housed on a base part, which is also provided with connection terminals. Likewise, it is also a function of said device to carry out a second retention in case the first retention existing between the connector and the base part fails, thus preventing disconnection.

This invention is preferably applicable to the manufacture and marketing of electric connectors for being used in the automotive industry.

2. Description of the State of the Art

Currently, connectors are widely known which permit, by means of a single operation, carrying out a quick and secure connection of a plurality of electric cables through pairs of connection terminals arranged respectively on a body and in a cavity of a base part susceptible to attaching together by carrying out the coupling of all the pairs of terminals at the same time.

There are connectors such as in Spanish Utility Model U200102974, belonging to the same applicant, and which discloses a connector provided with a lever with the interlocking device and which ensures the proper connection between the connector and base body.

Other connectors such as those disclosed in Spanish Utility Models U200000191 and U200000192 show in their description connector assemblies constituted of a body which internally houses a number of electric terminals in addition to a sliding body provided with respective parallel arms.

Both types of connectors only have a retention system of the connection between the terminals arranged on the connector and arranged on the base body, one of them carrying out the retention with means arranged on the lever and the other ones by means of sliding elements with tilted guides.

If subjected to extreme use conditions, said basic retention may fail mainly due to vibrations in the vehicle, which would cause the assembly disconnection, and to prevent this, this security device could be included, which facilitates the correct placement of the connector on the base body or part and also carries out a second retention.

DESCRIPTION

The device of the present invention consists of a screw with a special head slot, i.e., not universal (universal being understood as screw heads used with Allen wrenches, star-head screwdrivers and flat-head screwdrivers), specially designed for being handled with a specific tool and not universal (universal being understood as Allen wrench, star-head screwdriver and flat-head screwdriver tools), and partially introduced into a hollow trunco-conical part open at its bases and with an opening (17) in its wall.

For the use of this security device, it is necessary for the connector body to be coupled with base body or part to have, in its front or rear part, a cylindrical projection with a concentric cavity, such that when the connector is coupled on the base body, said hole is perfectly aligned with a hole existing on a projection perpendicular and attached to the base where the base body or part is located. The connection or coupling between the connector and base body is provided with a basic or primary retention system which keeps both components connected. When both bodies are aligned, the proper position of both devices is verified, and therefore, the correct carrying out of the connection between the terminals of both, the connector body having a number of connection terminals connected to conductor cables, and the base part also has connection terminals.

To secure the assembly, the security element is introduced, by means of hitting, through the hole of the projection perpendicular to the base body and in turn through the concentric cavity of the cylindrical projection of the connector. To release the electric assembly between the connector and base body, it is enough to turn the screw with the help of the special tool. By means of this mechanism, it is ensured that the connection can be handled only by specialists who have the tool, for security reasons, in addition to ensuring a proper connection under extreme conditions to which it is subjected.

BRIEF DESCRIPTION OF DRAWINGS

To facilitate understanding of the present invention, six figures are attached in order to better understand the principles on which the invention at hand is based and to better understand the description of a preferred embodiment, keeping in mind that the character of these figures is illustrative and non-limiting.

DETAILED DESCRIPTION

Figure 1:
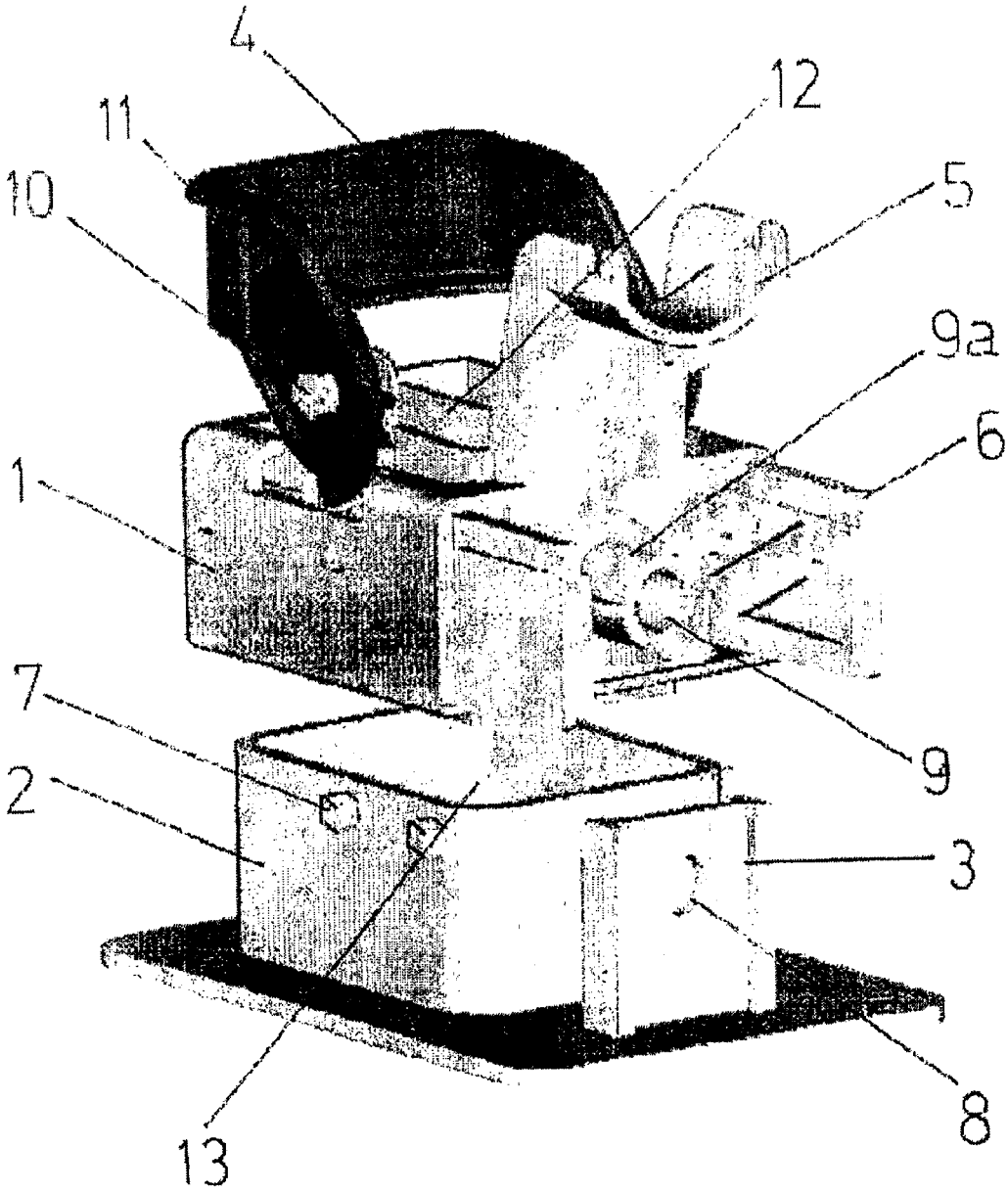
FIG. 1 shows a view of the elements constituting the invention prior to assembly thereof, of the connector and base body.
Figure 2:
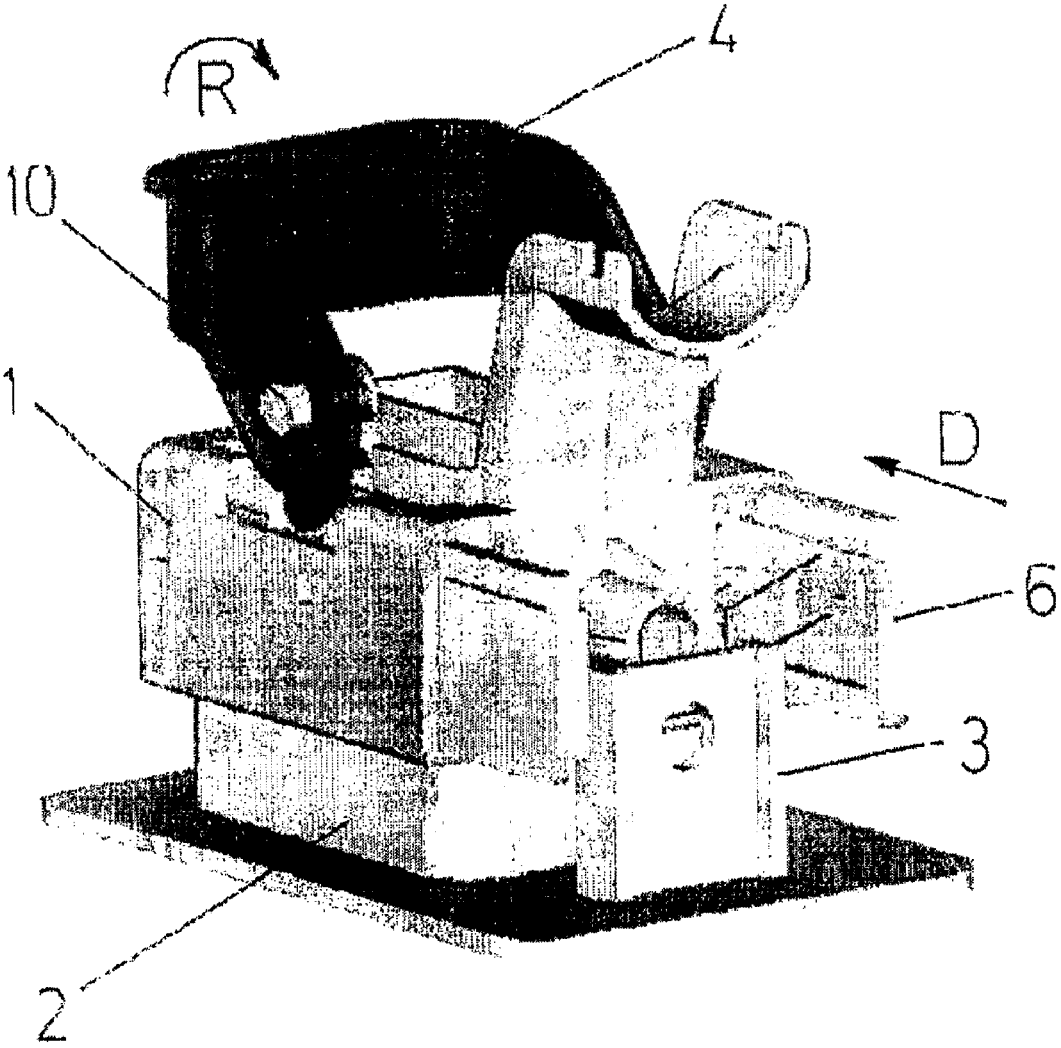
FIG. 2 shows a view of the connector partially introduced in the base body.
Figure 3:
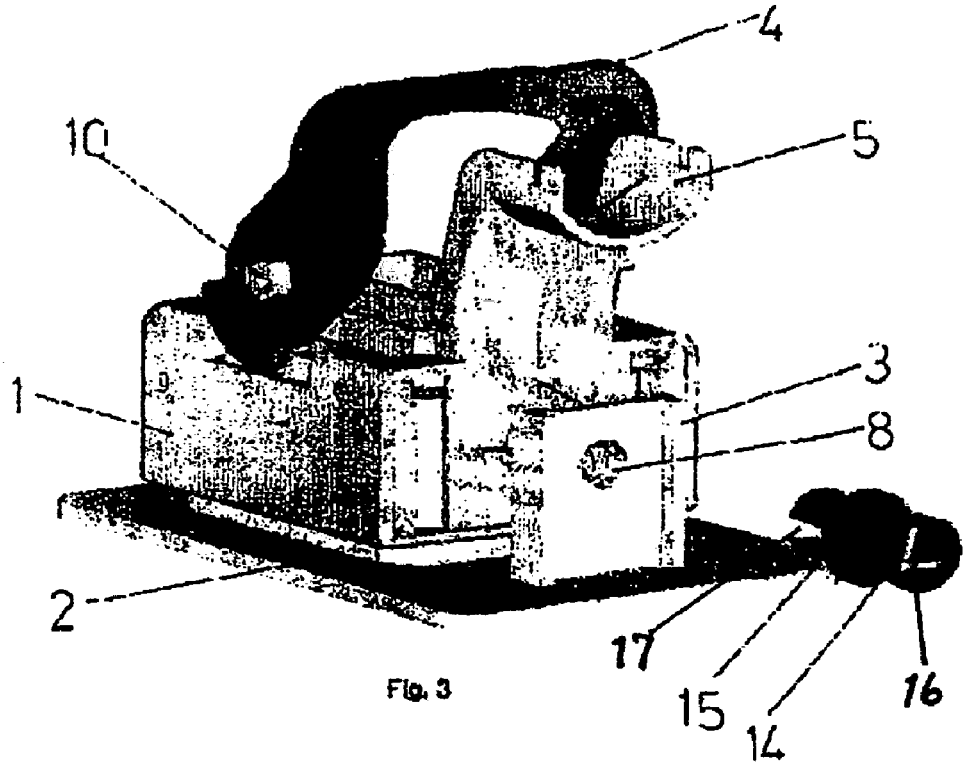
FIG. 3 shows a view with the connector completely introduced in the base body with the security element arranged to be introduced.
Figure 4:
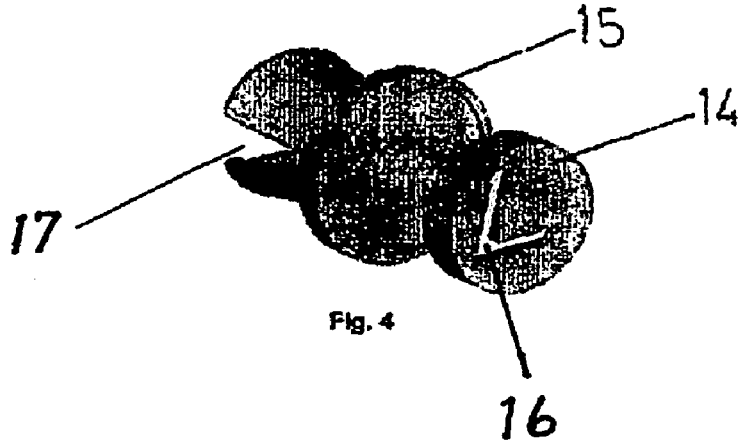
FIG. 4 shows the security element.
Figure 5:
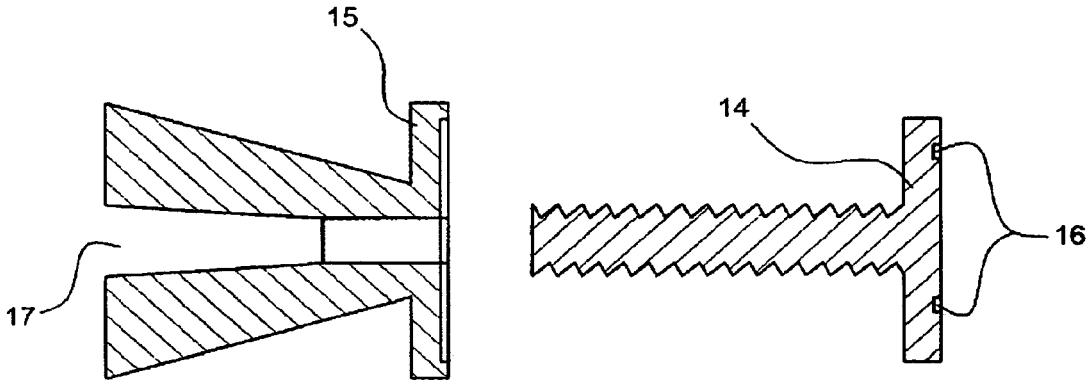
FIG. 5 shows an exploded cross section view of FIG. 4.
Figure 6:
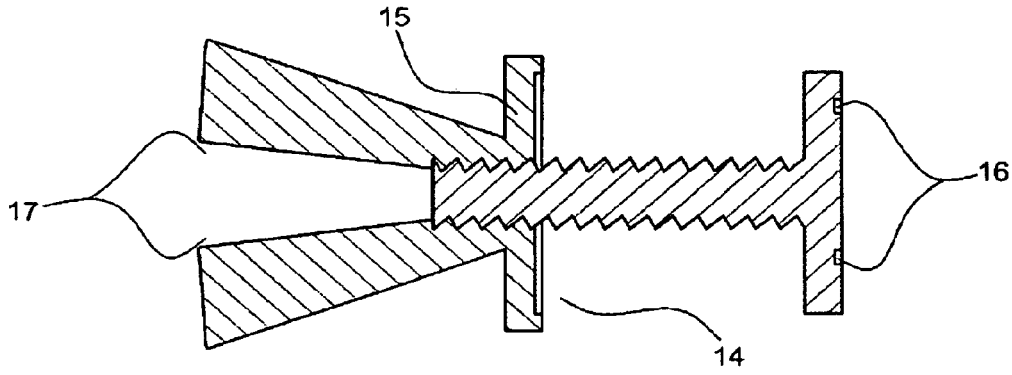
FIG. 6 shows a cross section view of FIG. 4.

The connector comprises a base body 1 provided with three grooves on its sides into which two sliding elements 6 with tilted guides have been partially introduced. Perpendicular to the front wall of the connector, the connector has a hollow cylindrical projection 9*a* with an inlet thereto 9. In the upper part of the connector, a U-shaped support 5 is provided, intended for supporting the cables connected to the connector terminals, which are located in space 12, which support is for a proper guiding of the cables. Said cables are trapped between the previous support 5 and lever 4 when the lever turns or pivots with regard to pivots 10, being retained in its final position by retention means 11.

The base body 2 is provided with a space 13 where other terminals are arranged with which those terminals introduced in the connector 1, specifically in housing or housings 12, make contact, concluding the electric connection. On the side walls of said base body 2, at least two small projections 7 are arranged which will be introduced in the guides existing on the sliding elements 6 of the connector body 1. In the front part of the base body 2, independent therefrom but fixed to the same base support, there is a projection 3 perpendicular to said base which is provided with a small through hole 8.

The security element of the system comprises a screw 14 with a particular head slot 16 intended for only being used by a tool specially designed for said head slot 16. Said screw 14 is introduced into the hollow trunco-conical part 15, being open at its two ends and having a side opening 17 in its wall.

To carry out the connection between the connector body 1 with its terminals inserted in housing or housings 12, and the base body 2, with other terminals in housing 13, it is enough to place the connector body 1 on the base body 2, the walls of said base body 2 thus being partially introduced inside of the connector body 1. Once they are placed in this position, the pivot projections 7 of the wall of the base body will be introduced in the guides of the sliding elements 6 located on the sides of the connector body 1, and for carrying out the connection, it is enough to turn the lever 4 with regard to the pivots 10 in rotation direction R or in counter-clockwise direction. This movement will cause in a horizontal shift D of the sliding elements 6 pushed by the lever 4 towards the inside of the connector body 1, which will make the pivots 7 run on the inside of the guides of said sliding elements 6, putting the terminals of the connector body 1 in contact with those of the base body 2. This connection will be secured in a first phase by the retention means 11 arranged on the lever 4, and which will also actuate the connector body 1. Once both bodies are assembled, the hole 9 of the cylindrical projection 9*a* of the connector body 1 will be facing the hole 8 of the base, thus verifying the correct placement of the connector 1 on the base body 2.

To ensure there is no manipulation of said connection by non-specialists, and for preventing the possible disconnection due to use conditions, the security element is introduced through hole 8 of the base and hole 9 of the connector body 1. Said element is snapped in by means of hitting it, which causes the trunco-conical element or cap 15 to close on the threading of the screw 14, said cap 15 remaining inside of the cylindrical body 9*a* and therefore the connection between the two base and connector bodies is secured.

To undo the connection, it is necessary to unscrew the screw 14 with the special tool and after removing it, it is necessary to undo all of the steps previously carried out, beginning by turning the lever 4 in a direction opposite the previous R direction.

Once both bodies are coupled, the terminal cables arranged in the connector body 1 are held between the lever 4 and the support 5.

Within its essence, the invention can be carried out in practice in other embodiments differing only in details from the one indicated as an example. This invention could thus be carried out in any shape and size, with the most suitable means and materials and with the most suitable accessories, the component elements being able to be replaced with other technical equivalents, as all this is comprised within its claims.

The invention claimed is:

1. A connector assembly security device, used in connector assemblies formed by a connector body (1), which is provided with a determined number of terminals which have the same number of cables associated to them, and has on its front wall a cylindrical projection (9*a*) with a hole (9) and a base body (2) which is also provided with terminals for their connecting with those arranged on the connector body (1), and which is located on a base support provided with a projection (3) placed perpendicular to the base support in the front part of the base body (2), and further having a hole (8) complimentary to said hole (9) when said connector body (1) and said base body (2) are fully engaged, characterized in that said security device comprises, in its position prior to assembly, a screw (14) partially inserted into a hollow trunco-conical part (15), said part (15) being open at its two ends and also having a side opening (17) on its wall intended for closing on the screw (14) when the device is introduced by snapping into holes (8) and (9).

2. A security device according to claim 1, said screw (14) having a non-universal slot (16) configuration.

* * * * *